US005803102A

United States Patent [19]

Ko

[11] Patent Number: 5,803,102

[45] Date of Patent: Sep. 8, 1998

[54] PROTECTING STRUCTURE OF CONTROL MEMBERS OF A FOLDED UMBRELLA

[76] Inventor: Chin-Sung Ko, 27-1, Lane 188, Sec. 3, Chin Mar Road, Changhua City, Taiwan

[21] Appl. No.: 926,004

[22] Filed: Sep. 9, 1997

[51] Int. Cl.[6] ..... A45B 25/14

[52] U.S. Cl. ..... 135/24; 135/22

[58] Field of Search ..... 135/22, 23, 24, 135/25.1, 20.3, 28, 25.4

[56] References Cited

U.S. PATENT DOCUMENTS

| | | | |
|---|---|---|---|
| 680,661 | 8/1901 | Hunt | 135/24 |
| 4,807,655 | 2/1989 | Robertson | 135/22 |
| 4,928,718 | 5/1990 | Apple | 135/22 |
| 5,144,969 | 9/1992 | Chou et al. | 135/22 |
| 5,174,319 | 12/1992 | Chou et al. | 135/24 X |
| 5,505,222 | 4/1996 | Lin et al. | 135/24 |
| 5,533,541 | 7/1996 | Cheng et al. | 135/24 X |
| 5,626,160 | 5/1997 | Ko | 135/24 X |

*Primary Examiner*—Lanna Mai
*Attorney, Agent, or Firm*—Rosenberg, Klein & Bilker

[57] ABSTRACT

The present invention relates generally to an umbrella, and more particularly to an umbrella provided with improved protecting structure of control members by which the automatic opening and closing of the umbrella are capable of being control, and under the improved control members providing, they have a protecting effect on control cord being connected with the control piece which will be kept in a stayed position when a mistake press on the button unknowingly happens.

2 Claims, 5 Drawing Sheets

PROTECTING STRUCTURE OF CONTROL MEMBERS OF A FOLDED UMBRELLA

BACKGROUND OF THE INVENTION

A prior art folded umbrella uses a spring set and a control member within a handle accompanying by a retaining piece which connects with a pair of control cords extending outside to pass through a runner and combining with an upper rib holder to control an automatic opening or closing of the umbrella. Referring to FIGS. 1 and 2, it shows a prior art folded umbrella which utilizes a pair of control members 22, 23 in the handle 2 of the umbrella. By pressing a button 21 which pushes the control members to open or close the umbrella. Usually, when a user goes out and carries this folded umbrella which is put in her bag or purse. It happens sometimes that the button 21 is pressed unknowingly which will release the runner 7 from a middle tube 12 of the umbrella as at a position of FIG. 2 while the rib frame of the umbrella is still not opened. In this manner, an inclined piece 24 becomes horizontal that provides a standby situation for closing the umbrella when pressing the button 21 again. If the user takes out the umbrella and presses the button 21 at this time, she will destroy the control cords 51 because of a sudden jump of the retaining piece 14 as the umbrella has not been opened firstly.

In view of the drawbacks, the primary object of the present invention is to provide an umbrella which is capable of overcoming the drawbacks of the prior art umbrella disclosed.

Now, the structure and features of this invention are described below in detailed with reference to the accompanying drawings.

DETAILED DESCRIPTION OF THE PREFERRED EMBODIMENT

Figure 1:
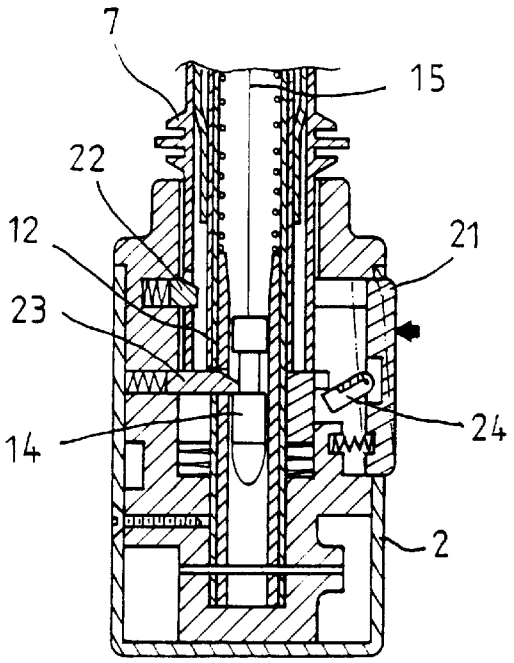
FIG. 1 (prior art)
FIG. 1 shows a cross sectional view of a part of a prior art handle of a folded umbrella.
Figure 2:
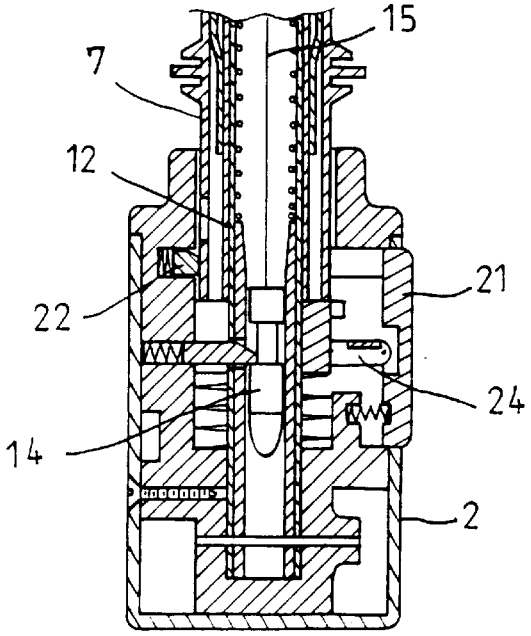
FIG. 2 (prior art)
FIG. 2 shows another cross sectional view of FIG. 1 which is at a position to be closed of the umbrella.
Figure 3:
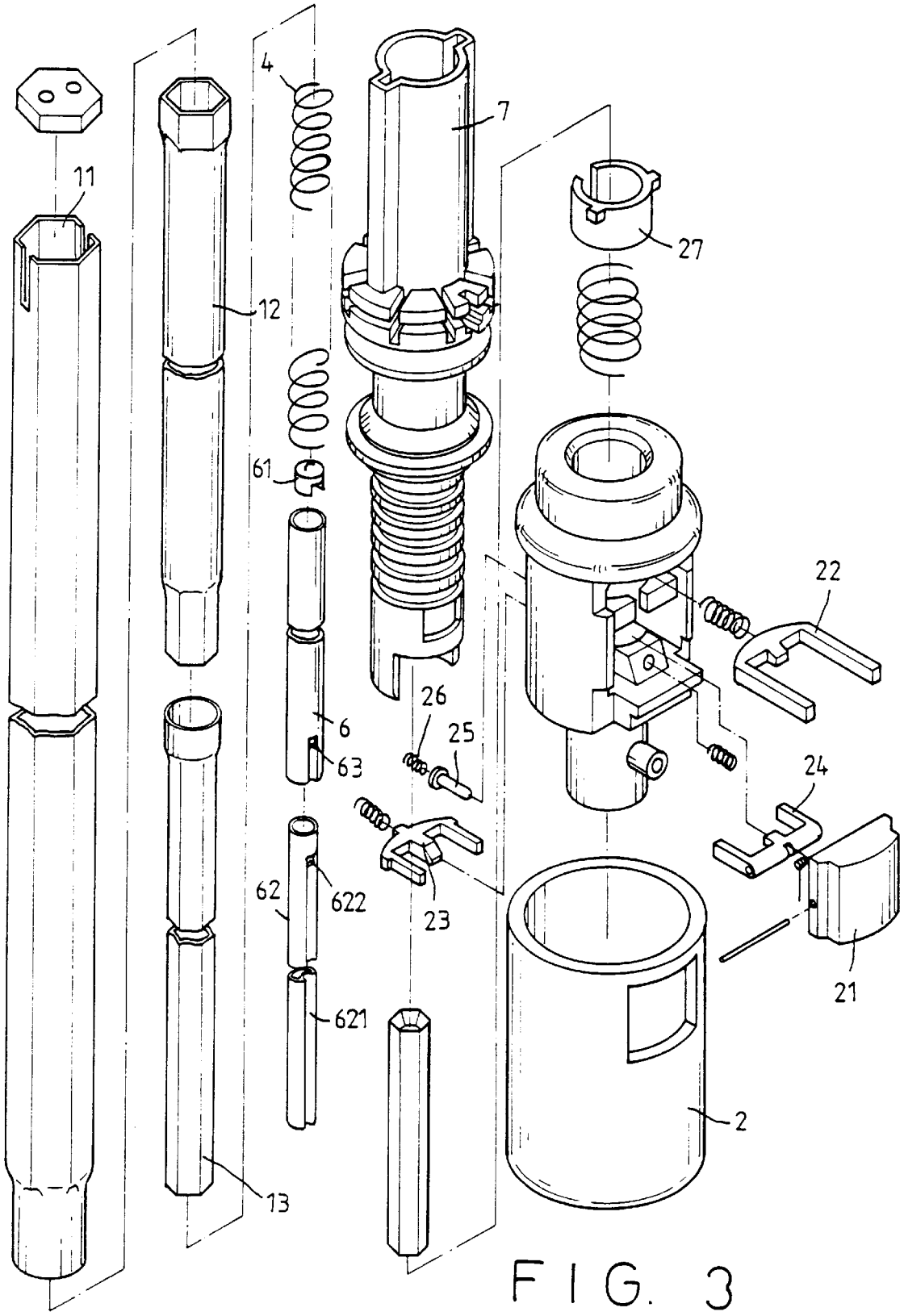
FIG. 3 is an exploded perspective view of parts of a three folded umbrella according to the present invention.
Figure 4:
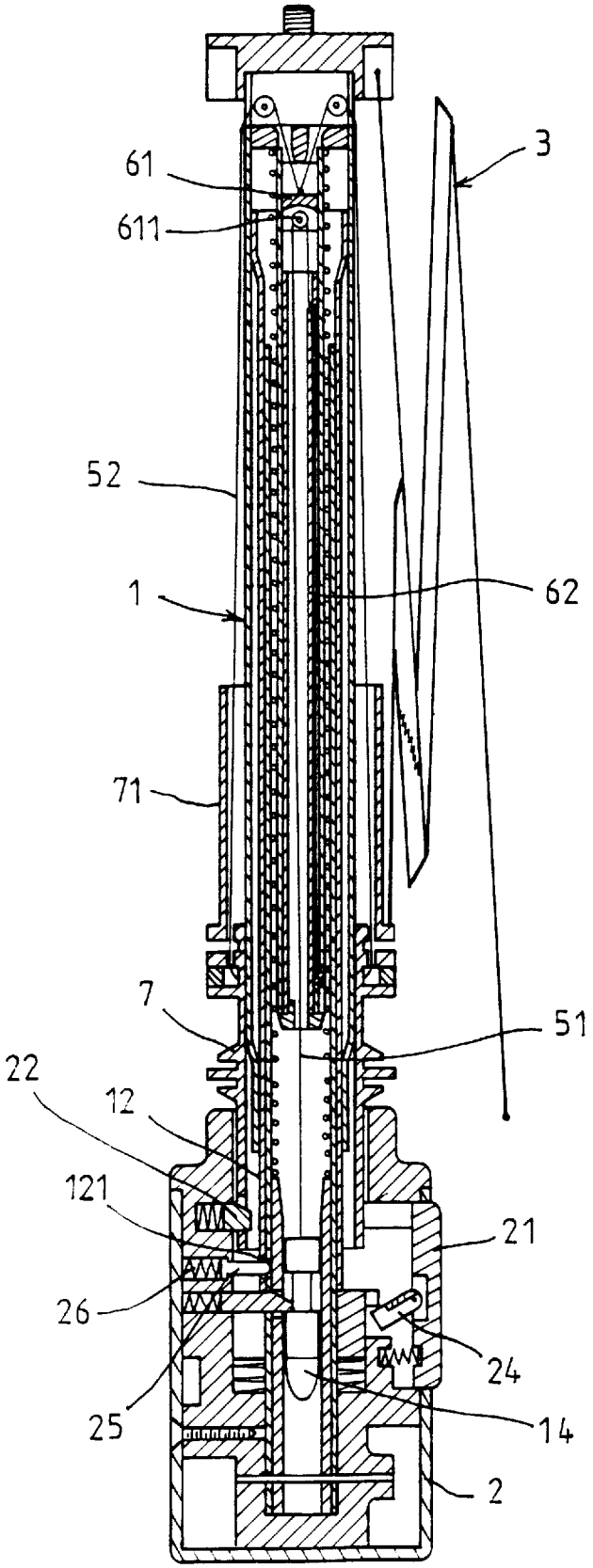
FIG. 4 is a cross sectional view of the umbrella according to this invention in a closed structure.

Referring to FIGS. 3 to 4, it can be seen that an umbrella embodied it the present invention is composed of a shaft 1 having an outer tube 11, a middle tube 12, and an inner tube 13, a handle 2, a rib frame 3, and an inner spring set 4, and it utilizes a button 21 of the handle 2 to control an engagement or a disengagement of a pair of control members 22, 23 with the middle tube 12 and a retaining piece 14 for an opening or a closing of the umbrella, in which the principle and the movement of each member are similar to a prior art and will not be detailedly disclosed thereafter.

Figures 6, 7:
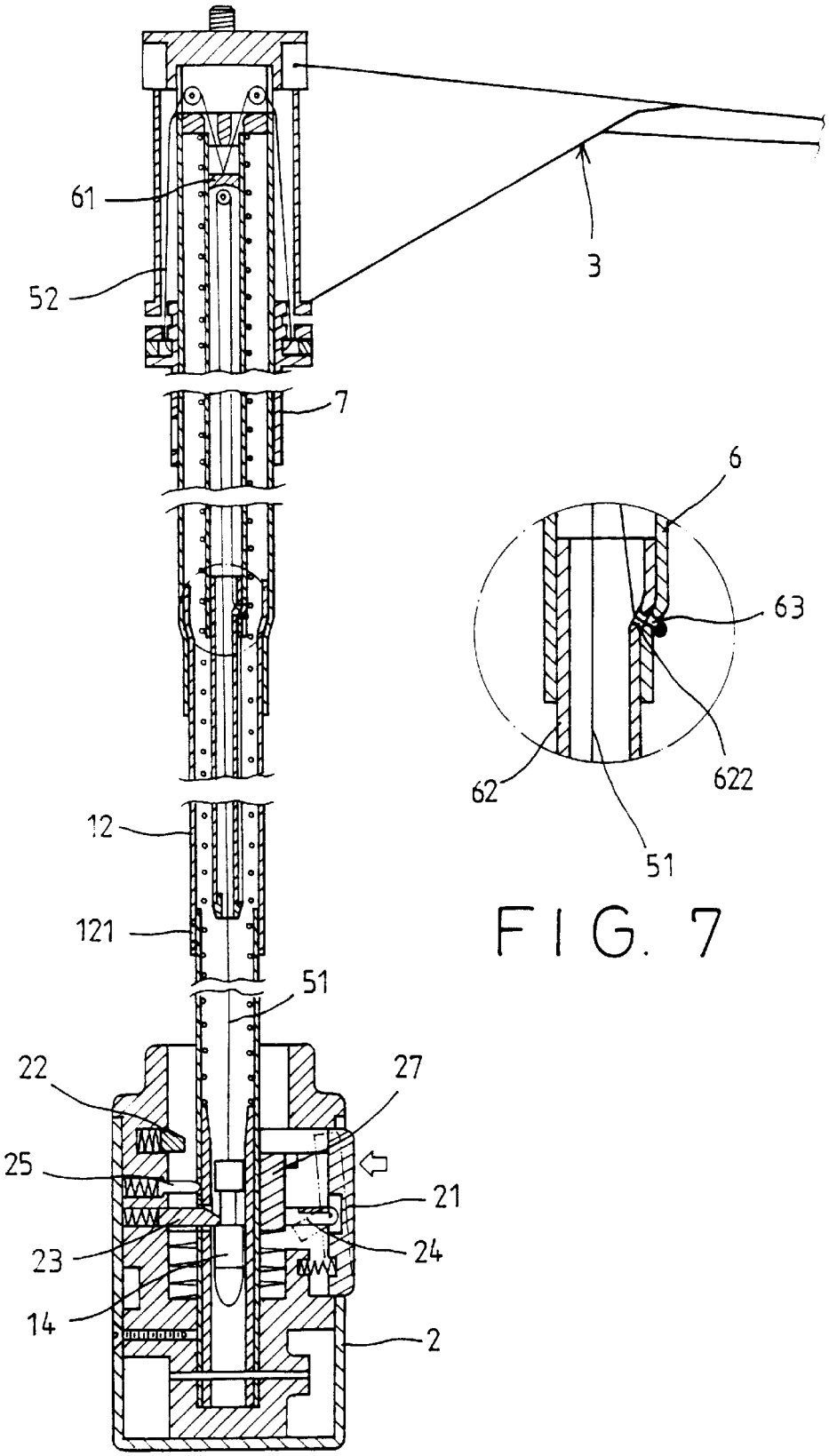
FIG. 6 is sectional view of the umbrella according to this invention in an opened structure.
FIG. 7 is an enlarged view of a part of FIG. 6.

It can be seen that an inner sleeve 6 within the shaft 1 is provided with an upper fixed member 61 and a slidable tube 62. An axis 611 is formed in the fixed member 61 and an arched groove 621 is formed on one side of the tube 62 which is placed in the sleeve 6. A long control cord 51 has its inner end connecting with the retaining piece 14 and the other end upwardly extending to turn around the axis 611 of the fixed member 61 and then downward inserting into the sleeve 6 and the tube 62 and passing through a hole 622 at top of the arched groove 621 and a connecting hole 62 of the sleeve 6 for a combination, as shown in FIGS. 6 and 7. A pair of short control cords 52 have their inner ends connecting with the fixed member 61 and their outer ends extending directly outwardly from the top of the shaft 1 and extending to the opposed sides of the runner 7.

Figure 5:
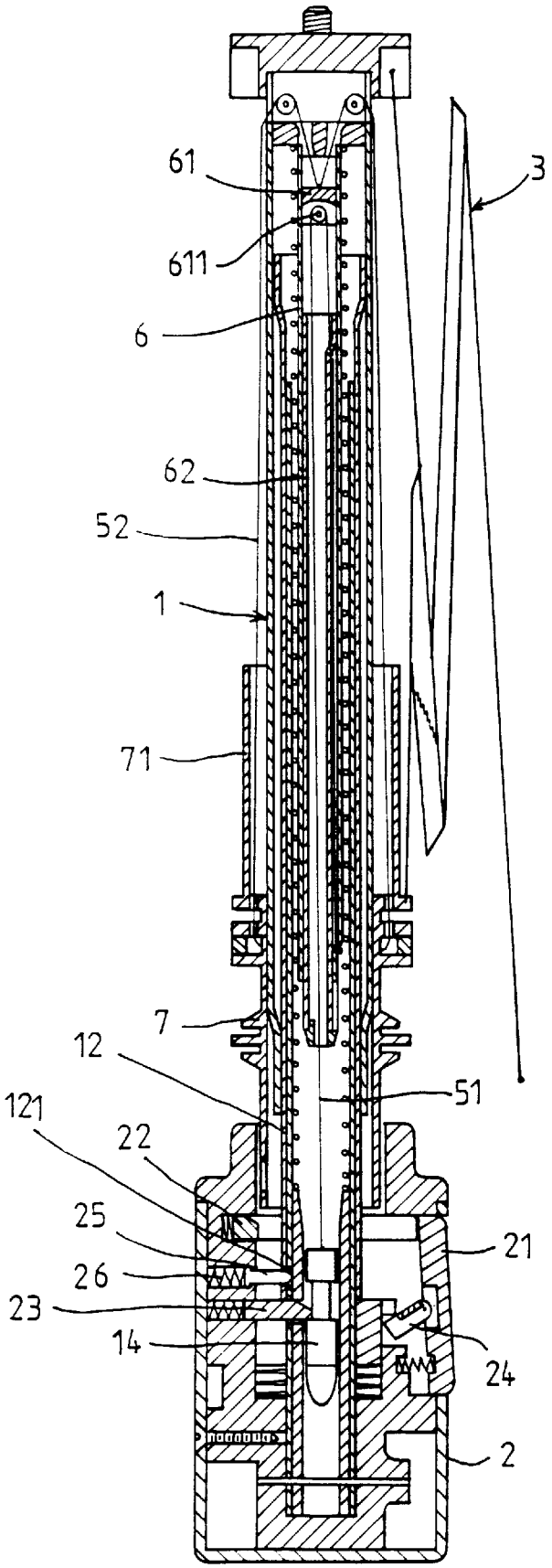
FIG. 5 is a cross sectional view of FIG. 4 when the button is pressed unknowingly in user's bag or purse.

Please referring to FIGS. 3 to 5, an engaged rod 25 is provided in the handle 2 in the present invention which is accompanying with a spring to provide a force intending to the axis of the shaft 1. A positioned hole 121 is formed at a lower position of the middle tube 12 for engaging with the rod 25 as in FIG. 4. When a mistaken press on the button 21 happens, the runner 7 is released and moved a small distance while the umbrella is not opened. At this time, the middle tube 12 will be limited and stayed because of the engagement between the rod 25 and the hole 121 while a control ring 27 in the handle 2 will not be moved upwardly that keeps the inclined piece 24 remaining inclinedly as shown in FIG. 5. So, when this umbrella is taken out and the button 21 is pressed again, the retaining piece 15 will not be released and jumped as the prior art structure since the inclined piece 24 is kept inclinedly and will not contact the control member 23. The control cords 51 is thus protected. After the umbrella is opened, the middle tube 12 will be moved upwardly by inner spring set 4 since the recovery force of it is larger than the engaged force with the rod 25. The inclined piece 24 becomes horizontal that provides a standby manner for closing the umbrella if we press the button 21 to control the inclined piece 24 to push the control member 23 for releasing the engagement with the retaining piece 15 which is then capable of being moved upwardly and the umbrella will be closed.

I claim:

1. A protecting structure of control members of a folded umbrella being composed of a shaft having an outer tube, a middle tube, and an inner tube, a handle, a rib frame, and an inner spring set, and utilizing a button of the handle to control an engagement or a disengagement of a pair of control members with a retaining piece for an opening or a closing of the umbrella, and characterized in that:

An inner sleeve within the shaft being provided with an upper fixed member and a slidable tube, and an axis formed in the fixed member and an arched groove formed on one side of the tube placed in the sleeve;

A long control cord having its inner end connecting with the retaining piece and the other end upwardly extending to turn around the axis of the fixed member and then downward inserting into the sleeve and the tube and passing through a hole at top of the arched groove and a connecting hole of the sleeve for a combination; and A pair of short control cords having their inner ends connecting with the fixed member and their outer ends extending directly outwardly from the top of the shaft and extending to the opposed sides of the runner.

2. The protecting structure of control members of a folded umbrella as claimed in claim 1, wherein an engaged rod being provided in the handle accompanying with a spring to provide a force to the axis of the shaft, and a positioned hole formed at a lower position of the middle tube for engaging with the rod.

* * * * *